US006477922B1

(12) United States Patent
Burnett

(10) Patent No.: US 6,477,922 B1
(45) Date of Patent: Nov. 12, 2002

(54) IMPACT TOOL

(76) Inventor: John A. Burnett, 39940 N. Bartlett La., Wadsworth, IL (US) 60083

( * ) Notice: Subject to any disclaimer, the term of this patent is extended or adjusted under 35 U.S.C. 154(b) by 0 days.

(21) Appl. No.: 09/403,650

(22) PCT Filed: Apr. 29, 1998

(86) PCT No.: PCT/US98/07479

§ 371 (c)(1),
(2), (4) Date: Oct. 25, 1999

(87) PCT Pub. No.: WO98/48978

PCT Pub. Date: Nov. 5, 1998

(51) Int. Cl.[7] ..... B25D 1/00
(52) U.S. Cl. ..... 81/22; 81/20; 81/26
(58) Field of Search ..... 81/20, 21, 22, 81/25, 26

(56) References Cited

U.S. PATENT DOCUMENTS

| | | | | |
|---|---|---|---|---|
| 1,045,145 A | | 11/1912 | Hubbard | |
| 1,501,095 A | | 7/1924 | Brock | |
| 2,451,217 A | | 10/1948 | Heinrich | |
| 2,737,216 A | | 3/1956 | Kenerson | |
| 2,776,689 A | | 1/1957 | Falzone | |
| 2,833,323 A | | 5/1958 | Strickland | |
| 3,000,414 A | | 9/1961 | Cordis | |
| 4,039,012 A | | 8/1977 | Cook | |
| 4,183,385 A | | 1/1980 | Burkybile | |
| 4,216,808 A | | 8/1980 | Royce | |
| 4,331,193 A | | 5/1982 | Tudisco | |
| 4,373,565 A | | 2/1983 | Soto | |
| 4,498,464 A | | 2/1985 | Morgan, Jr. | |
| 4,738,166 A | | 4/1988 | Yamaguchi | |
| 4,831,901 A | | 5/1989 | Kinne | |
| 5,012,702 A | * | 5/1991 | Taylor | 81/25 |
| 5,216,939 A | | 6/1993 | Swenson | |
| 5,249,776 A | | 10/1993 | Johnson | |
| 5,289,742 A | | 3/1994 | Vaughan | |
| 5,375,487 A | | 12/1994 | Zimmerman | |
| 5,408,902 A | * | 4/1995 | Burnett | 81/22 |
| 5,537,896 A | | 7/1996 | Halder | |

FOREIGN PATENT DOCUMENTS

| | | | |
|---|---|---|---|
| EP | 412030 | * | 2/1991 |

* cited by examiner

*Primary Examiner*—Eileen P. Morgan
*Assistant Examiner*—Joni B. Danganan
(74) *Attorney, Agent, or Firm*—John W. Harbst

(57) ABSTRACT

An impact tool having a head structure including first head piece, a second head piece and an elongated handle structure. With a lengthwise section of the handle structure being arranged in operative association with and maintaining the first and second head piece of the head structure in operative combination relative to each other. A woven fiber material is arranged about and epoxied to the lengthwise section of the handle structure arranged in operative association with the first and second heads to enhance the interface therebetween.

25 Claims, 10 Drawing Sheets

FIG. 1
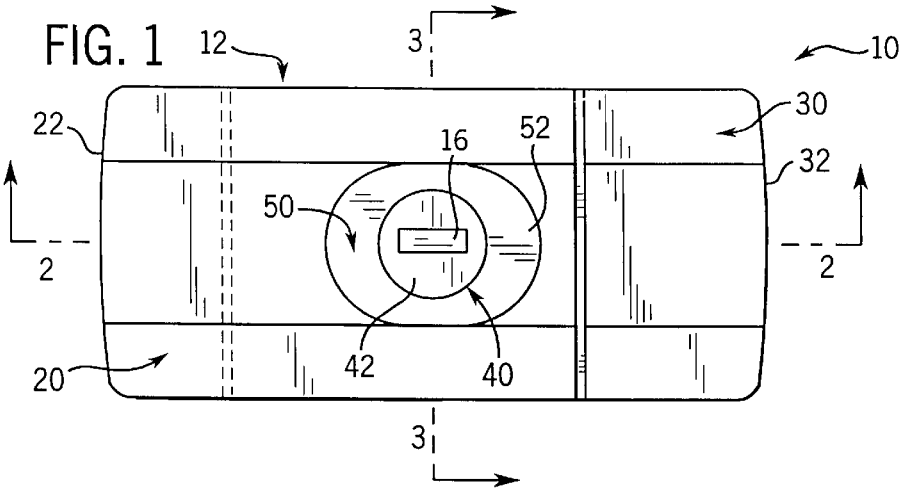
FIG. 2
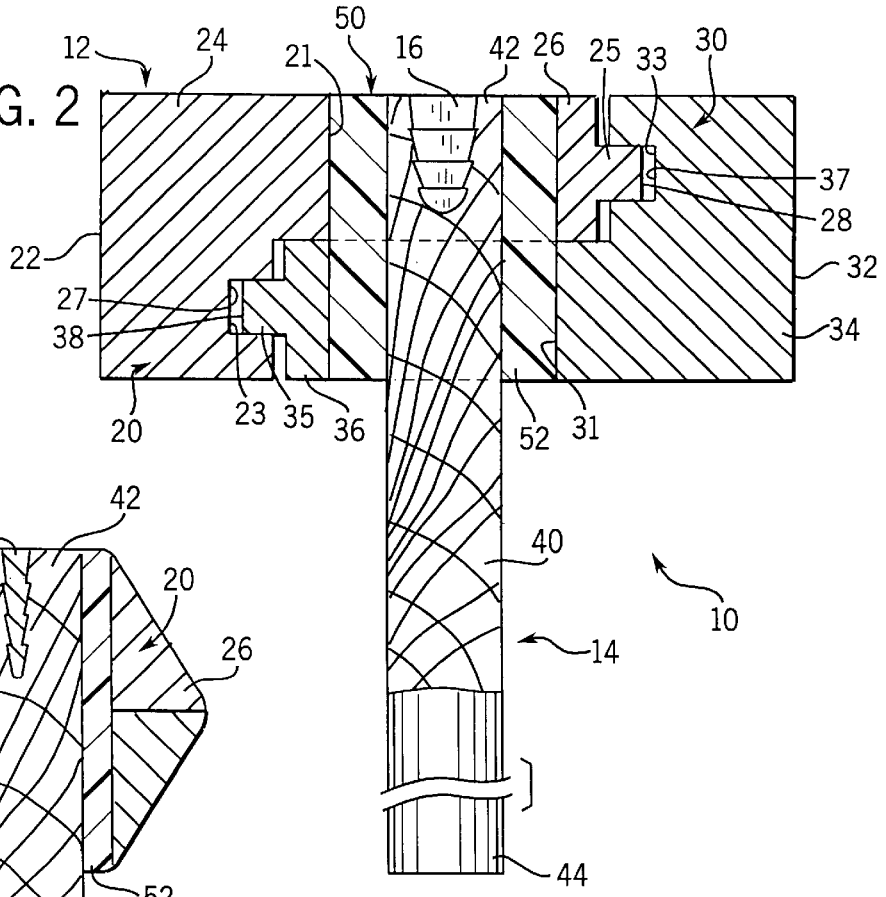
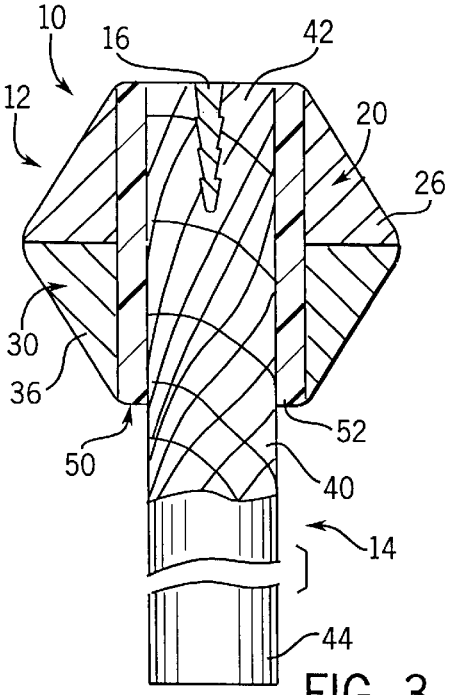
FIG. 3

26
21
28
24
25
20
22
27
23
34
30
33
37
31
38
36
35

IMPACT TOOL

FIELD OF THE INVENTION

The present invention relates to hand held manually operated tools and, more particularly, to impacts tools such as hammers and the like having a head structure including two separated members which are joined by an elongated handle structure.

BACKGROUND OF THE INVENTION

Impact tools such as hammers, axes, picks and other hand held manually operated striking tools are well known and have been used for centuries. Each of these tools come in a variety of shapes and sizes. The specific construction of the impact tool varies widely according to the desired specified use.

Such tools are typically provided with a one-piece head structure formed from steel or the like and usually includes two metallic impact or striking surfaces. Carpentry hammers typically have a metal striking head at one end and a claw configuration at an opposite end. Alternatively, the hammer can include heads formed from a softer material such as lead or hardened rubber material to provide nonmarring impact surfaces.

Hammers typically have included a handle extending away from the head structure to provide the hammer with a generally T-shaped configuration. The one-piece head structure is typically created from a forging operation to add strength to the head structure of the impact tool. Typically, a lengthwise portion of the handle fits through a bore or opening provided in the one-piece head structure. A wedge or other suitable fastening device is driven into the free end of the handle to fasten the handle to the head structure.

When a tool such as a hammer is moved to strike a surface of an object, part of the kinetic energy developed through the hammer's swing is utilized in doing the desired work on the object being struck, another part is dissipated as heat, while another part is converted into potential energy in the form of recoil or rebound of the hammer from the surface being struck. The distortion of the striking surface of the hammer has potential energy much the same way as a compressed spring. It is this potential energy that causes the hammer to recoil or bounce back from the surface of the object being struck. Moreover, hammers usually transmit some force of the impact to the user's hand, which will increase efforts and labor of the user, thus reducing the operating efficiency of the tool.

To reduce this problem, there have been developed hammers offering a "dead-blow" characteristic. For example, attention is directed to my U.S. Pat. No. 5,408,902, offering a composite hammer embodying a split head design wherein a non-load bearing internal head assembly is carried by a rigid outer load bearing framework which provides strength and stiffness to the tool. The "dead-blow" characteristic offered by my patented tool is accomplished through a split head tool design that remarkably reduces and substantially eliminates transference of the impact from the striking head to the user's hand.

While the invention disclosed in my U.S. Pat. No. 5,408,902 offers significantly improved results over other impact tool designs, there is and industry mandates a continuing effort to improve product technology. As a result of those continuing efforts, the present invention has been realized.

SUMMARY OF THE INVENTION

In view of the above, and in accordance with a preferred form of the present invention, there is provided an impact tool including a head structure with first and second members extending in opposite directions from each other but which are maintained in interconnected relationship relative to each other by a handle structure extending normally from and secured to the head structure.

In one form of the invention, the members of the head structure are formed from metal. In that embodiment wherein the impact tool is configured as a hammer, at least one of the members of the head structure is a striking head which can include an exposed metal striking surface. The other member of the head structure for the hammer can be configured as a claw or, alternatively, a second striking head with an exposed metal striking surface.

In a preferred form of the invention, each member of the head structure includes a working portion and an attachment portion. The attachment portion of each member of the head structure extends, at least partially, in surrounding relation relative to a lengthwise portion of the handle structure so as to prevent the member from becoming disassociated with the handle. Forming the attachment portion of a claw-like configured head with a clevis-like configuration appears beneficial to distribute forces imparted thereto during operation of the tool.

The handle structure includes an elongated handle formed from any of a myriad of materials selected from the class comprising; wood, plastic, metal, nylon, fiberglass, an elastomer, or suitable rigid material. In a preferred form, the handle structure further includes a wedge-like member driven into the free end of the handle. The wedge-like member serves to maintain the handle structure and head structure in secured engagement relative to each other.

In accordance with one aspect of the present invention, and while remaining interconnected through the handle structure, the members of the head structure are separated from each other in an axial direction. The spacing between the members of the head structure allows for movement of the head structure members in response to one of the head structure members being struck against a surface. That is, when one member or head of the head structure is struck against a surface, the spacing between the heads or members of the head structure allows the unstruck head to move toward and impact against the struck head thereby providing a secondary blow that inhibits the tool's struck head from rebounding from the struck surface and thereby dampening vibration through the handle.

In a preferred form of the invention, the attachment portions of the heads or members of the head structure are configured with confronting impact surfaces. The spacing mentioned above is provided between the impact surfaces on the heads or members of the head structure. The range of spacing between the members of the head structure varies and is dependent upon a number of factors. That is, the spacing between the members of the head assembly varies as a function of the mass distribution or geometry of the head structure members, the material from which the head structure members are formed, the timing of the collision between the head structure members, and the length of time the striking surface of the head structure striking member remains in contact with the struck surface. A spacing between the impact surfaces ranging between about 0.010 inches to about 0.070 inches appears appropriate.

To promote movement of the members or heads of the head structure moving toward each other in response to use, the tool of the present invention can further include elastomeric material disposed between the handle of the tool and the heads or members of the head structure. The elastomeric material has a hardness ranging between about 40 Shore A durometer hardness and about a 95 Shore A durometer hardness. Suffice it to say, the elastomeric material acts as a spring for returning the nonstruck head to a normal or operational position after moving toward and impacting with the struck head or member of the head structure. Accordingly, any suitable material which, during operation of tool, will initially compress and subsequently return the unstruck head to an operational position will suffice.

Another aspect of the present invention relates to configuring at least one of the members of the head structure from laminations. The other member or head of the head structure is captively received between laminations of the other member. After captively arranging the heads or members of the head structure relative to each other, the laminations are fixedly secured to each other. The handle of the tool extends through and is maintained in association with either of the members or heads of the head structure and extends generally perpendicular relative thereto.

With this aspect of the present invention, a striking plate or cap can be arranged in combination with the laminations. The striking plate defines a striking surface for the tool and, thus, inhibits separation of the laminations during use of the tool.

With the present invention, the head structure preferably comprises dual heads or members which are generally axially aligned relative to each other. Because the heads or members of the head assembly of the present invention can be manufactured separately, the manufacturing equipment and processes for forming the heads or members of the head structure are significantly simplified, thus, reducing manufacturing costs and thereby enhancing the selling price of the tool. Configuring one or more of the striking heads with laminations furthermore enhances the manufacturing process.

Arranging elastomeric material between the heads and the handle of the tool furthermore enhances this invention. The elastomeric material effectively isolates the heads from the handle and thereby significantly reduces vibration transfer from the head structure through the handle and to the user's hand.

The concept of splitting the heads of the head structure to allow for axial movement of the heads relative to each other furthermore enhances performance characteristics of the present invention. Thus, when one head or member of the head structure is struck against a surface, the other head or member of the head structure acts as a lagging mass and provides a secondary blow to inhibit the struck head from rebounding from the surface being struck. According, an advantageous "dead-blow" feel is provided to the tool. It has been found that vibrations normally experienced in the handle of the tool are not discernable with the tool designed in accordance with the present invention.

Still another aspect of the present invention involves arranging a skin of resin impregnated fiber material, preferably an arimid fiber material, along and about the lengthwise portion of the handle structure extending into operative association with the head structure of the impact tool. Preferably, an epoxy is used in combination with the fiber material or skin. Moreover, the fiber skin or material plus the epoxy defines a more cumbersome path for impact vibrations to traverse between the striking head of the head structure and the handle structure thereby significantly reducing vibration transference during use of the tool. Additionally, a cosmetic cover is preferably arranged beneath the head structure and extends about the handle of the handle structure to aesthetically cover any free ends of the fiber material extending from the head structure of the tool. As will be appreciated from an understanding of this aspect of the present invention, the presence of an epoxy material about that portion of the handle structure extending into operative combination with the head structure will enhance securement of the head structure and handle structure to each other while advantageously dampening vibrations whether the head structure is of a unitary design or of the two piece design as disclosed above.

These and other objects, aims, and advantages of the present invention will become more readily apparent from the following detailed description of the invention, the appended claims, and the accompanying drawings.

BRIEF DESCRIPTION OF THE DRAWINGS

FIG. 1 is a top plan view of an impact tool embodying features of the present invention;

FIG. 2 is a sectional view taken along line 2—2 of FIG. 1;

FIG. 3 is a sectional view taken along line 3—3 of FIG. 1;

DETAILED DESCRIPTION OF THE PRESENT INVENTION

Figure 4:
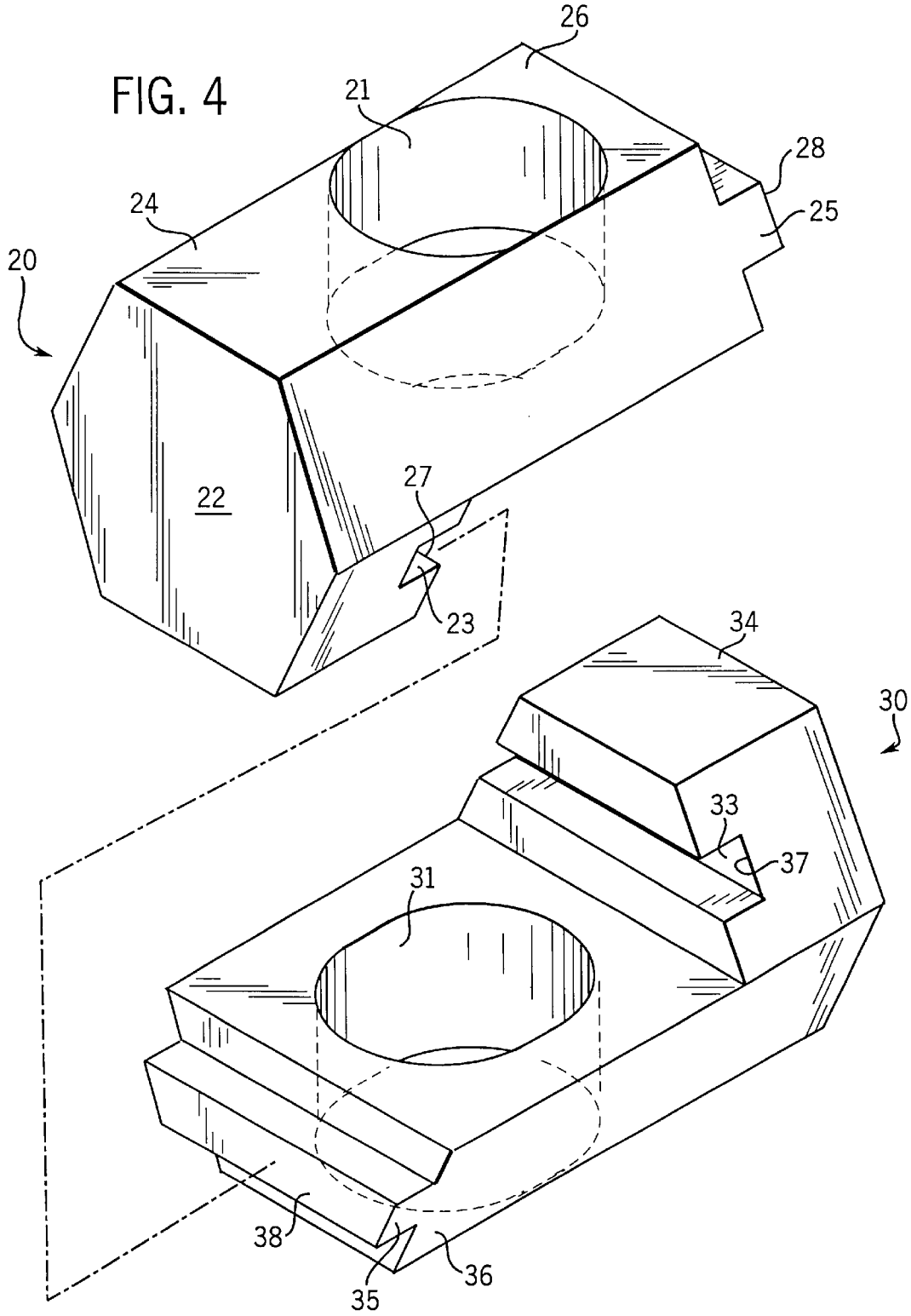
FIG. 4 is an exploded perspective view of the members forming a head structure of the impact tool illustrated in FIG. 1.

While the present invention is susceptible of embodiment in multiple forms, there are shown in the drawings and will hereinafter be described various preferred embodiments of the present invention with the understanding the present disclosure is to be considered as setting forth exemplifications of the invention which are not intended to limit the invention to the specific embodiments illustrated and described.

Referring now to the drawings, wherein like reference numerals indicate like parts throughout the views, there is shown in FIGS. 1 through 3 an impact tool 10 constructed in accordance with the present invention. The tool illustrated in FIGS. 1 through 3 for purposes of illustration is in the form of a hammer having exposed striking heads. It should be appreciated, however, the teachings of the present invention are equally applicable to other forms of impact tools such as axes, picks and the like tools.

In the example of the invention shown in FIGS. 1 through 3, and as is typical, hammer 10 has a generally T-shaped configuration and includes a head structure 12 with a handle structure 14 extending therefrom and in a generally perpendicular relationship therewith.

The head structure 12 includes first and second independent or separate heads or members 20 and 30 which, in the illustrated form of the invention, are generally axially aligned in a first direction relative to each other. The heads or members 20, 30 extend toward first and second sides, respectively, of the tool 10. In one form of the invention, the heads or members 20, 30 of the head structure 12 are fabricated from a suitable metal or metal alloy. The head or member 20 of head structure 12 defines an exposed striking surface 22 while head or member 30 of head structure 12 defines an exposed striking surface 32. As will be appreciated, the heads 20, 30 and the striking surfaces 22, 32 respectively, could be encased to limit marring of the surface struck or impacted with the tool without detracting or departing from the spirit and scope of the present invention. Moreover, the configurations of the heads or member 20, 30 of head structure 12 can be other than that shown without departing or detracting from the spirit and scope of the present invention.

The handle structure interconnects the heads 20, 30 of the head structure 12 to each other and extends in a second direction away from the head structure 12 to provide a generally T-shaped formation or configuration to the tool 10. The handle structure 14 includes an elongated handle 40, a lengthwise portion of which extends through and interconnects the heads or members 20, 30 of the head structure 12 to each other. The handle 40 of handle structure 14 is formed from a class of materials including: wood such as hickory, plastic, metal, nylon, fiberglass, elastomeric, or composite materials. In the illustrated form of the invention, the handle 40 of handle structure 14 is preferably of one-piece construction between opposite ends 42 and 44 thereof to reduce the opportunity of vibrations passing therethrough.

As shown in FIG. 2, the head piece or member 20 of the head structure 12 includes a working portion 24 and an attachment portion 26. Similarly, the head piece or member 30 of the head structure 12 includes a working portion 34 and an attachment portion 36. Notably, a lengthwise portion of the handle 40 extends through and interconnects the attachment portions 26, 36 of the heads or members 20, 30 of the head structure 12.

The head pieces or members 20, 30 of the head structure 12 are configured to interconnect relative to each other to prevent their inadvertent separation from each other and from the handle structure 14 during use of the impact tool. To prevent the head pieces or members 20, 30 from moving beyond a predetermined axial distance or becoming disassociated with the handle structure 14 during use the tool 10, the attachment sections or portions 26, 36 are each configured to surround more than a 180' circumferential segment of the lengthwise portion of the handle 40 extending therethrough. In the illustrated form of the invention, shown in FIG. 4, each head piece or member 20, 30 defines a bore 21, 31, respectively, extending therethrough for accommodating endwise reception and holding of a lengthwise portion of the handle 40.

As shown in FIGS. 2 and 3, handle structure 14 furthermore preferably includes a wedge-like insert 16 is driven into the free upper end 42 of the handle 40 passing through the attachment portions 26, 36 of the heads or members 20, 30, respectively, thereby facilitating securement of the head structure 12 to the handle structure 14. Of course, adhesive or other forms of attachment devices can be used to secure the head structure 12 to the 40 handle structure 14 in addition to the use of a wedge-like member 16 without detracting or departing from the spirit and scope of the present invention.

The head pieces or members 20, 30 of the head structure 12 are furthermore configured to prevent their axial displacement along the length of the handle 30. As mentioned, the attachment sections or portions 26, 36 of the head pieces 20, 30, respectively, are each secured to a lengthwise portion of the handle structure 14 extending therethrough. Moreover, the attachment sections 26, 36 of the heads or members 20, 30 of the head structure 12 are vertically arranged relative to each other to prevent their inadvertent displacement along the axial length of the handle 40 during operation of the tool 10.

As shown in FIGS. 2 and 4, the attachment portion 26, 36 of each head piece or member 20, 30 is configured with an axially extending recess 23, 33 shaped to complement an axial projection 25, 35 defined on the heads or members 20, 30 of the head structure 12. As will be appreciated, and as shown in FIG. 2, when the head pieces or members 20, 30 of the head structure 12 are assembled relative to each other, the axial projection 25 on the head or member 20 is accommodated within the complementary shaped axially extending recess 33 defined on the head piece or member 30 of head structure 12. Similarly, and after the head pieces or members 20, 30 of the head structure 12 are assembled relative to each other, the axial projection 35 on the head or member 30 is accommodated within the complementary shaped axially extending recess 23 defined on the head piece or member 20 of head structure 12. Since the head pieces 20, 30 are each secured to a lengthwise portion of the handle structure 14 extending therethrough, the relationship of the projections 25, 35 coact with the recesses 23, 33 to prevent displacement of the head pieces or members 20, 30 relative to each other and along the length of the handle structure 14 even if the securement between the one of the head pieces or members 20, 30 fails.

According to one salient feature of the present invention, the head pieces or members 20, 30 of the head structure 12 are axially separated from each other by a predetermined axial distance. As shown in the drawings, the head pieces 20 30 of the head structure 12 are separated from each other in an axial or first direction extending generally perpendicular to the axis of the handle 40 a distance ranging between about 0.010 inches and about 0.070 inches. The distance separating the heads or members 20, 30 of head structure 12 being substantially exaggerated in the drawings for purposes of explanation.

As shown in FIGS. 2 and 4, the head pieces or members 20, 30 of head structure 12 are provided with complementary and confronting impact surfaces that are axially separated from each other by the predetermined distance mentioned above. In the illustrated form of the invention, an impact surface 27 is provided within the recess 23 on the head piece or member 20 of head structure 12 in spaced and confronting relationship relative to an impact surface 38 on the axial projection 35 of head piece or member 30 of the head structure 12. Similarly, an impact surface 37 is provided within the recess 33 on the head piece or member 30 of head structure 12 in spaced and confronting relationship relative to impact surface 28 on the axial projection 25 head piece or member 20 of the head structure 12.

In this, as well as the other illustrated forms of the invention disclosed herein, only one set or pair of complementary confronting impact surfaces necessarily needs to be spaced apart the preferable range of about 0.010 inches to about 0.070 inches. Other confronting impact surfaces defined on the head pieces or members 20, 30 of the head structure 12 can be spaced a further distance apart from each other without detracting or departing from the spirit and scope of the present invention. As will be appreciated, and as shown, more than one impact surface can be defined on the head pieces or member 20, 30 of head structure 12 without detracting or departing from the spirit and scope of the present invention as long as the axial spacing between the confronting surfaces is the same.

Another salient feature which distinguishes the present invention from heretofore known tools relates to isolating the two-piece head structure 12 from the handle structure 14 to significantly reduce vibrations transmitted to and through the handle 40 to the user. As shown in FIGS. 1 through 3, elastomeric material 50 is provided between the handle structure 14 and the head pieces or members 20, 30 of the head structure 12 along the lengthwise portion of the handle 40 extending through the head structure 12. Notably, the elastomeric material 50, disposed between the head pieces 20, 30 of the head structure 12 and the handle structure 14, promotes axial movement of the unstruck head piece toward the head piece that is struck against a surface.

In the illustrated form of the invention, a sleeve 52 formed from an elastomeric material is disposed about and along the lengthwise portion of the handle 40 passing through the head structure 12. The elastomeric sleeve 52 is secured to that lengthwise portion of the handle structure 14 passing through the head structure 12 and to each of the head pieces or members 20, 30 of the head structure 12 as by adhesive or the like. As will be appreciated, and in addition to the wedge-like member 16 driven into the free end 42 of the handle 40, the adhesiveness of the sleeve 52 to the heads or members 20, 30 and to the handle portion 40 furthermore facilitates maintaining the head structure 12 in operable association with the handle structure 14.

As will be appreciated by those skilled in the art, the elastomeric material can take a myriad of forms. In the preferred embodiment, an elastomeric composition having a Shore A durometer hardness ranging between about 40 and 95 appears to be best suited for this application.

Figure 5:
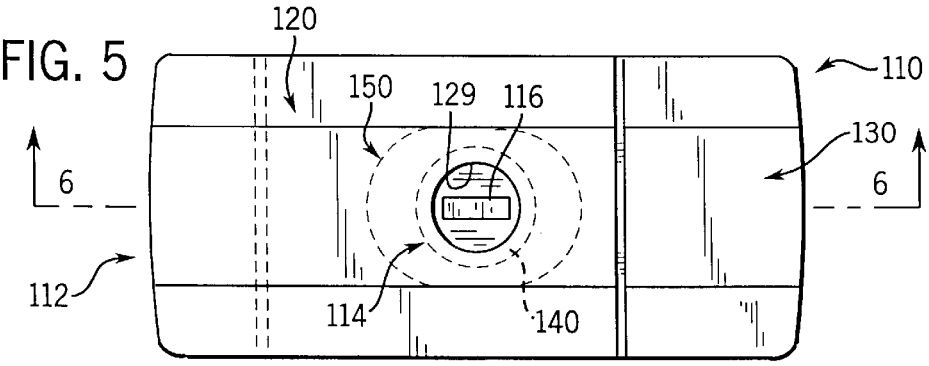
FIG. 5 is a top plan view of the alternative embodiment of the present invention.
Figure 6:
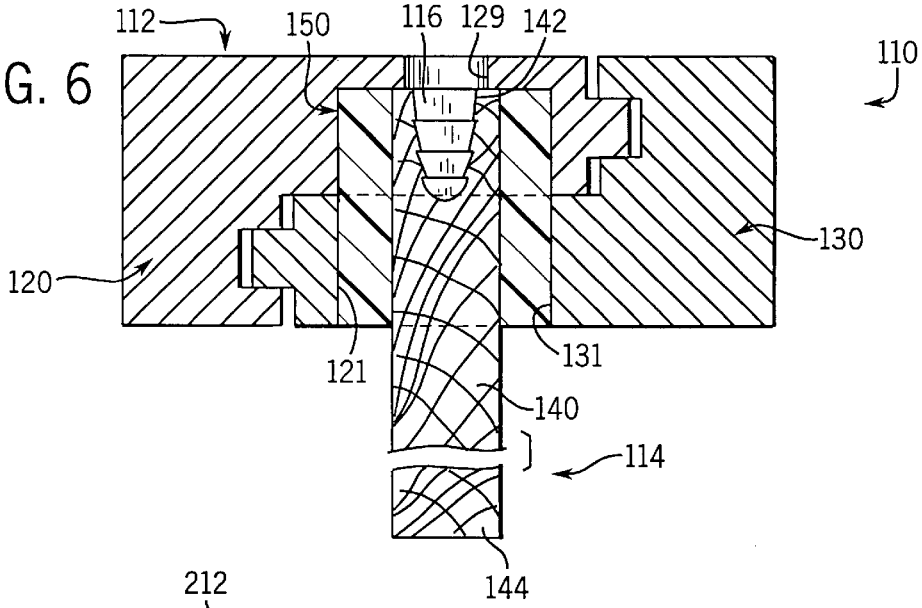
FIG. 6 is a sectional view taken along line 6—6 of FIG. 5.

Another embodiment of a tool embodying features of the present invention is schematically illustrated in FIGS. 5 and 6. This alternative form of impact tool is designated generally by reference numeral 110. The elements of this alternative form of impact tool that are identical to or functionally analogous to those components discussed above regarding impact tool 10 are designated by reference numerals identical to those used above with the exception that this embodiment uses reference numerals in the 100 series.

In this embodiment of the invention, the head structure 112 and handle structure 114 are substantially similar to that discussed above. As mentioned above, the head structure 112 includes a pair of axially separated striking heads 120, 130. Moreover, the handle structure 114 includes an elongated handle 140 having opposite ends 142, 144.

The head piece or member 130 of the head structure 112 defines a bore 131 extending therethrough and through which a lengthwise portion of the handle structure 114 extends. The head piece or member 120 of the head structure 112, however, defines a counterbore 121 which accommodates a lengthwise portion of the handle 140 of handle structure 114. In the embodiment of the invention schematically illustrated in FIG. 16, the handle structure 114 furthermore preferably includes a wedge-like insert 116. As shown, the head piece or member 120 of head completely therethrough. Notably, the counterbore 121 of head piece or member 120 can be structure 112 is provided with an aperture or opening 129 for permitting endwise passage of the wedge-like member therethrough and into the free end of the handle 140 thereby enhancing securement of the head structure 112 and handle structure 114 in operative combination relative to each other.

Notably, the counterbore 121 of the head piece or member 120 and the bore 131 of head piece or member 130 are each configured to accommodate elastomeric material 150 disposed, at least, on opposite sides of the handle structure 114. As will be appreciated, and as discussed in detail above, the handle structure 114 and/or the elastomeric material 150 can be suitable secured to the head structure as through adhesive or the like.

Figure 7:
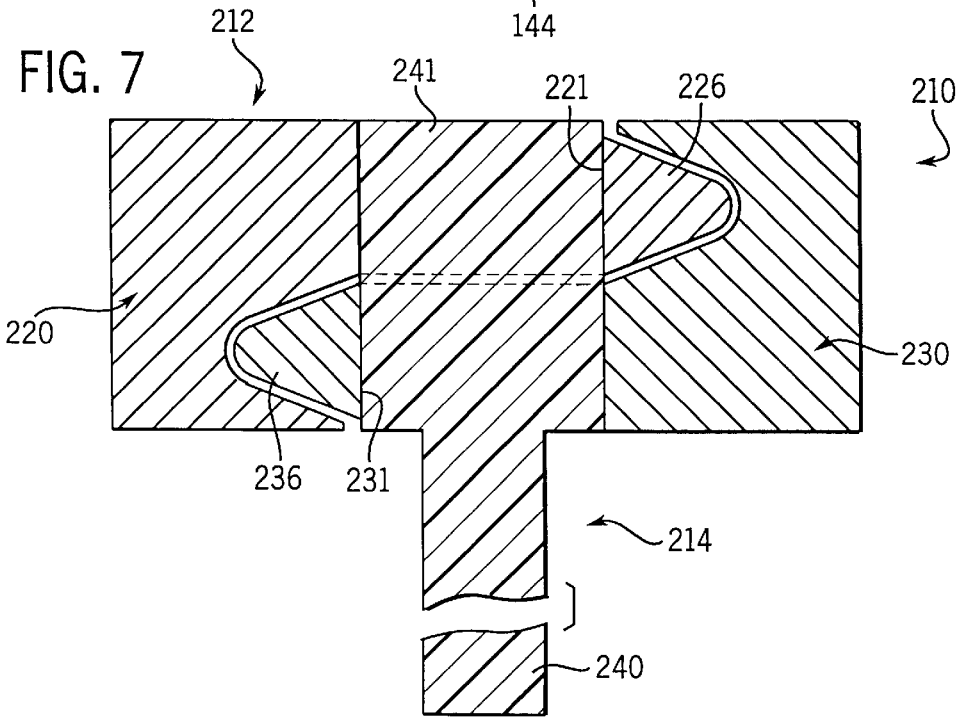
FIG. 7 is a longitudinal sectional view of another alternative form of the present invention.

Another embodiment of a tool embodying features of the present invention is schematically illustrated in FIG. 7. This alternative form of impact tool is designated generally by reference numeral 210. The elements of this alternative form of impact tool that are identical to or functionally analogous to those components discussed above regarding impact tool 10 are designated by reference numerals identical to those used above with the exception that this embodiment uses reference numerals in the 200 series.

In this embodiment of the invention, the head structure 212 is substantially similar to that discussed above. As mentioned above, the head structure 212 includes a pair of axially separated striking heads 220, 230. The head pieces or members 220, 230 of the head structure 212 defines bores 221, 231, respectively, extending therethrough and through which a lengthwise portion of a handle structure 214 extends to hold the attachment portions 226, 236 of the head pieces or members 220, 230, respectively, together in interconnected relationship relative to each other. Of course, with a simple change the bore 221 of head piece 220 could be configured with a counterbore like head piece 120 discussed above without detracting or departing from the spirit and scope of the present invention.

The handle structure 214 in this embodiment of the invention extends through and holds the head pieces 220, 230 of the head structure 220 in axially separated relation relative to each other. In this embodiment, the handle structure 214 includes an elongated handle 240 with an enlarged head piece 241 toward that end that passes endwise through the attachment portions 226, 236 of the head pieces or members 220, 230, respectively, of the head structure 212. In this embodiment of the invention, at least the enlarged head piece 241 of handle structure 214 is formed from an elastomeric composition having a Shore A durometer hardness ranging between about 40 and 95.

The enlarged head piece 241 of handle 240 is sized to snugly fit within bores 221, 231 defined in the head pieces or members 220, 230 of the head structure 212 and be secured thereto as with adhesive. The handle structure 214 can further include a wedge-like member (not shown) driven onto the free end thereof, or any other suitable affixation device or method. As discussed above, attachment portions 226, 236 of the head pieces or members 220, 230, respectively, extend at least partially in surrounding circumferential relation relative to a lengthwise portion of the enlarged head piece 242 thereby preventing complete separation of the head pieces or members 220, 230 from the handle 240. Although the attachment portions 226, 236 of the head pieces or members 220, 230, respectively, of the head structure 212 appear different than the attachment portions 26, 36 discussed above regarding head pieces 20, 30, they are intended to serve the identical function to that discussed above and are maintained in normally separated relation relative to each other.

Figure 8:
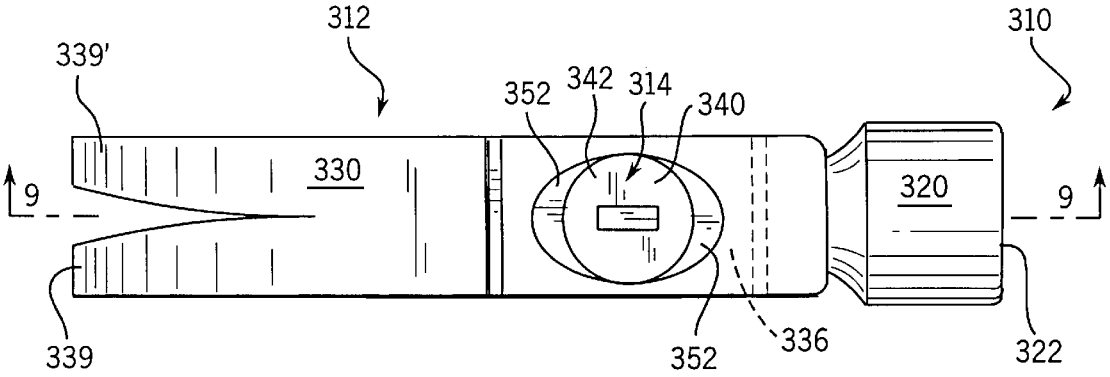
FIG. 8 is a top plan view of another alternative embodiment of the invention.
Figure 9:
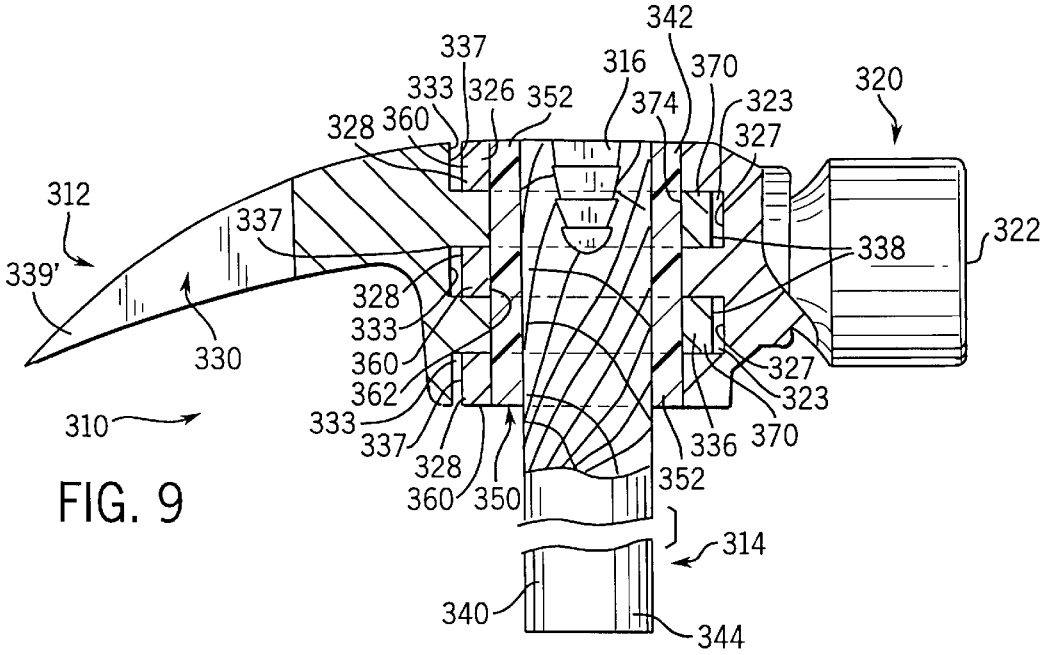
FIG. 9 is a sectional view taken along line 9—9 of FIG. 8.

Another embodiment of a tool embodying features of the present invention is schematically illustrated in FIGS. 8 and 9. This alternative form of impact tool is designated generally by reference numeral 310. The elements of this alternative form of impact tool that are identical to or functionally analogous to those components discussed above regarding impact tool 10 are designated by reference numerals identical to those used above with the exception that this embodiment uses reference numerals in the 300 series.

In this embodiment of the invention, the tool 310 is configured as a carpentry hammer. The head structure 312 of the hammer 310 includes first and second pieces or members 320, 330, respectively, joined to each other by an elongated handle structure 314 extending generally normal to and away from the head structure 312. The handle structure 314 includes an elongated handle 340, a lengthwise portion of which extends through and interconnects the heads or members 320, 330 of the head structure 312 to each other. The handle 340 is preferably formed from a class of materials including: wood such as hickory, plastic, metal, nylon, fiberglass, elastomeric composite materials. The handle 340 is preferably of one-piece construction between opposite ends 342 and 344 thereof. The handle structure 314 furthermore preferably includes a wedge-like structure or insert 316 forced into the upper free end 342 of the one-piece handle 340 of handle structure 314. The insert 316 of handle structure 314 circumferentially expands that end of handle structure 314 passing, at least partially, through the head structure 312 thereby enhancing the securement of the handle structure 314 to the head structure 312.

As shown, the first piece 320 of the head structure 212 is configured as a striking head with a striking surface 322. The other piece or member 330 of the head structure 312 has a claw-like configuration including a pair of laterally spaced tines or members 339 and 339' extending away from handle 340 of the handle structure 314.

To promote axial movement of the heads or members 320, 330 of the head structure 312, elastomeric material 350 is inserted between opposed sides of the handle 340 and attachment portions 326, 336 of the heads or members 320, 330, respectively, of the head structure 312. As will be appreciated, the elastomeric material furthermore isolates the head structure 312 from the handle structure 314 thereby inhibiting vibrations from being transferred along the length of the handle 314 to the user. In the illustrated form of the invention, the elastomeric material 350 is in the form of strips of elastomeric material 352 arranged between opposed lengthwise sides of the handle 340 and the heads 320, 330 of the head structure 312.

In this embodiment of the invention, the attachment portions 326, 336 of the head pieces or members 320 have a clevis-like configuration to enhance distribution of the forces acting on the heads or members 320, 330 of the head structure 312. In the embodiment illustrated in FIG. 9, the attachment portion 326 of the head piece or member 320 of head structure 312 includes an axially elongated vertically spaced projections 360. Each axially elongated projection 360 on head piece or member 320 defines an opening or aperture 362 circumferentially extending, at least partially, about a lengthwise section of the handle 340 to hold the striking head 320 to the handle structure 314. In the illustrated embodiment, the opening 362 defined by the attachment section 326 is sized to fit snugly about the elastomeric material 352 fitted about the handle 340.

The attachment portion 336 of the head piece or claw-like member 330 of the head structure is configured with a pair of elongated axially extending, vertically spaced projections 370 which, in the illustrated embodiment, are embraced by the projection 360 of head piece or member 320. The projections 370 of the head piece or claw-like member 330 define a pair of vertically aligned openings or apertures 374 which circumferentially extend, at least partially, about a lengthwise portion of the handle 340 extending endwise therethrough. In the illustrated embodiment, the openings 374 defined by the attachment section 336 of the head piece or claw-like member 330 are sized to fit snugly about the elastomeric material 352 fitted about the handle 353.

As shown in FIG. 9, the striking head 320 of head structure 312 is formed with axially elongated recesses 323 defining vertically aligned impact surfaces 327 for accommodating axial displacement of the attachment portion 336 of the claw-like member 330 there toward. Similarly, the claw-like member or head 330 of the head structure 312 is formed with axially elongated recesses 333 defining impact surfaces 337.

As shown, each of the axially elongated projections 360 forming part of the attachment portion 326 of the striking head 320 is formed with an impact surface 328 at the distal end thereof Moreover, the axially elongated projections 370 forming part of the attachment portion 336 of the claw-like member 330 of head structure 312 each define vertically aligned impact surfaces 338 at the distal ends of the projections 370, 372, respectively.

As shown in FIG. 9, when the heads 320, 330 are assembled relative to each other, the impact surfaces 328 on the head piece or member 320 of the head structure 320 are maintained in a predetermined spaced and confronting relationship relative to the impact surfaces 337 formed on the claw-like member or head 330. Moreover, when the heads 320, 330 are assembled relative to each other, the impact surfaces 338 at the distal ends of the projections 370 extending from the claw-like member 330 will be maintained in a predetermined spaced and confronting relationship relative to the impact surfaces 327 formed on the striking head 320.

Figure 10:
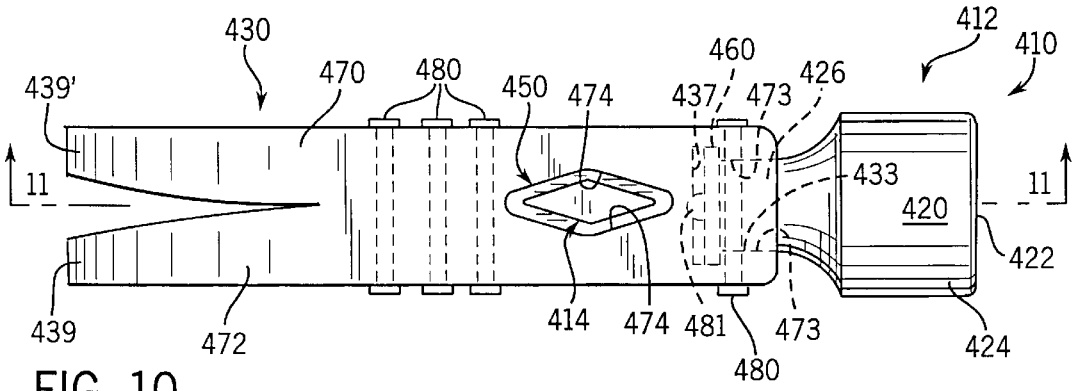
FIG. 10 is a top plan view of yet another alternative form of the present invention.
Figure 11:
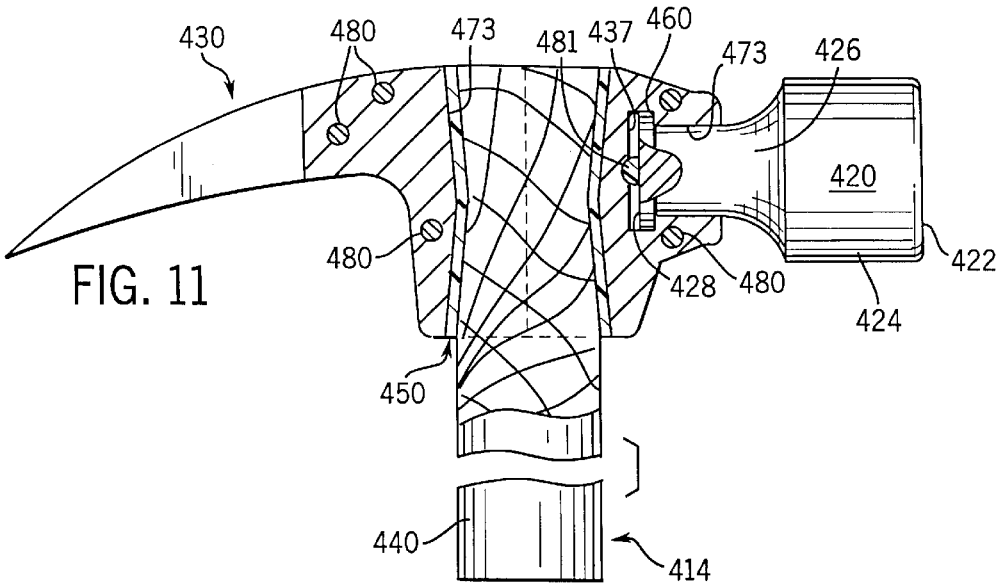
FIG. 11 is a sectional view taken along line 11—11 of FIG. 10.

Still another embodiment of a tool embodying features of the present invention is illustrated in FIGS. 10 and 11. This alternative form of impact tool is designated generally by reference numeral 410. The elements of this alternative form of impact tool that are identical to or functionally analogous to those components discussed above regarding impact tool 10 are designated by reference numerals identical to those used above with the exception that this embodiment uses reference numerals in the 400 series.

Tool 410 is again configured as a carpentry hammer. The head structure 412 of the hammer 410 includes first and second pieces or members 420, 430, respectively. The tool or hammer 410 further includes a handle structure 414 extending from the head structure 412 at a generally perpendicular relationship thereby providing a generally T-shaped configuration to the tool 410.

As shown, the first piece 420 of the head structure 412 is configured as a striking head with a striking surface 422. The other member 430 of the head structure 412 is configured with a claw-like design including a pair of laterally spaced tines or members 439 and 439'.

In this embodiment of the invention, the striking head 420 is preferably of one piece construction and includes a working portion 424 and an attachment portion 426. The attachment portion 426 of the striking head 420 is specifically configured to be captively received by the claw-like member 430 of the head structure so as to prevent its axial separation therefrom and yet allow a degree of axial movement along a predetermined path relative to the claw-like member or head piece 430. In the illustrated embodiment, the attachment portion 426 of the striking head 420 is configured with an enlarged end portion 460 to retain the head 420 in captive but axially slidable relationship relative to head piece 430.

The claw-like member 430 of the head structure 412 has a laminated configuration including first and second halves or pieces 470, 472 which are the mirror image of each other and, when assembled, provide the entire shape to the claw-like member 430 of the head structure 412. Each piece 470, 472 of the claw-like member 430 defines a open sided cavity 473 having a shape corresponding to one half of the attachment portion 426 of the striking head 420. Moreover, each piece 470, 472 of the claw-like member 430 defines an open sided channel 474 conforming to one-half of the cross-sectional configuration of the lengthwise portion of the one-piece handle 440 extending endwise therethrough.

In the illustrated form of the invention, and as made possible by the laminated structure of the head piece 430, the attachment portion 426 of the head piece 420 is captively received within a recess formed by the abutting cavities 473 defined by the pieces 470, 472 of the head piece 430 of the head structure 412 while the handle 440 forming handle structure 414 extends only through the head piece or claw member 430 of the head structure 412. The laminations 470, 472 forming the claw-like member 430 of the head structure 412 are fixedly held to each other as by a series or plurality of rivets 480 or other suitable securement devices.

As shown, the handle 440 has a changing cross-sectional configuration along that lengthwise portion extending through the claw-like member 430 of the head structure. The changing cross-sectional configuration of the handle 440 is specifically configured to secure the claw-like member 430 along the length of the handle structure 414. In the illustrated embodiment of the invention, a generally centralized lengthwise section of the handle 440 has a reduced outer configuration from those lengthwise sections of the handle 440 arranged adjacent upper and lower sides of the claw-like member 430. Accordingly, the handle 440 is prevented from axially moving along its length relative to the claw-like member. Of course, configurations other than that exemplified may equally suffice without detracting or departing from the scope of the present invention. Notably, however, the laminated or lengthwise split configuration of the member 430 allows such a design to capture the handle structure 414 relative to the head structure 412. Moreover, in the illustrated form of the invention, the handle 440 has a cross-sectional configuration which inhibits the handle 440 from rotating or turning relative to the head piece 430. Furthermore, and to inhibit vibrations from transferring along the length of the handle structure, the handle 440 is preferably configured as a one-piece member.

To further reduce vibrations from being transmitted along the length of the handle structure, elastomeric material 450 is inserted between the lengthwise portion of the handle 440 and the that portion of head piece 430 arranged in surrounding relationship thereto. As will be appreciated, the elastomeric material 450 only needs to be positioned on opposite sides of the handle 440 to promote axial movements of the head pieces 420, 430 toward each other. In the illustrated form of the invention, however, a sleeve 452 of elastomeric material is positioned along and about the lengthwise portion of the handle 440 extending through the head piece 430 of the head structure 412. The elastomeric material has a hardness ranging between about a Shore A durometer hardness and about a 95 Shore A durometer hardness.

As shown in FIGS. 10 and 11, the attachment portion 426 of the head piece or striking head 420 of the head structure 412 is configured with an elongated shank-like projection axially extending from the striking head 420 with an impact surface 428 at a distal end thereof Moreover, the claw-like member 430 is configured with a recess 433 shaped to accommodate the shank-like projection 426 on the head piece or member 420. Notably, an impact surface 427 is defined by the recess 473. As will be appreciated, when the heads 420, 430 are assembled relative to each other, the impact surface 428 on the striking head 420 and the impact surface 437 on the claw-like member 430 are in confronting but axially spaced relation relative to each other. The axial spacing having a predetermined distance therebetween. In the illustrated embodiment, an elastomeric material 481 is positioned between the impact surface 428 on the head or member 420 and the impact surface 437 on the claw-like member 430 to act as a spring for maintaining the axially spaced relationship between the confronting impact surfaces defined by the head or members 420, 430 of the head structure 412.

Figure 12:
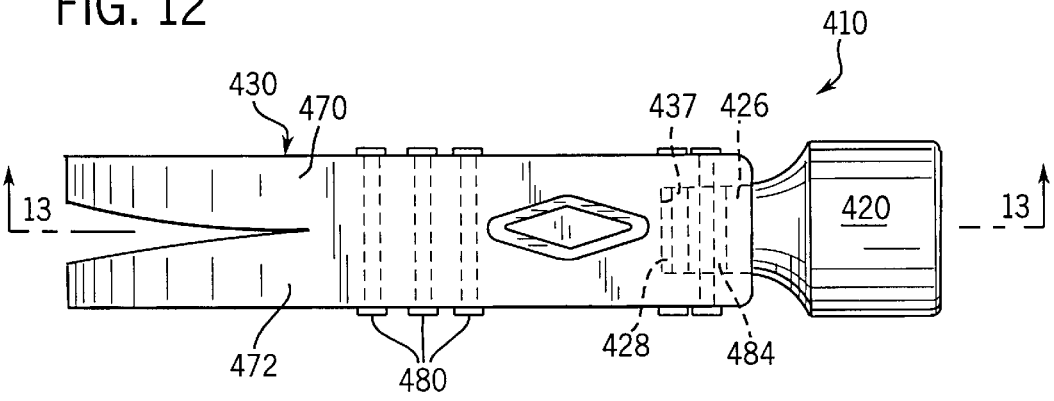
FIG. 12 is a top plan view of another alterative form of the present invention.
Figure 13:
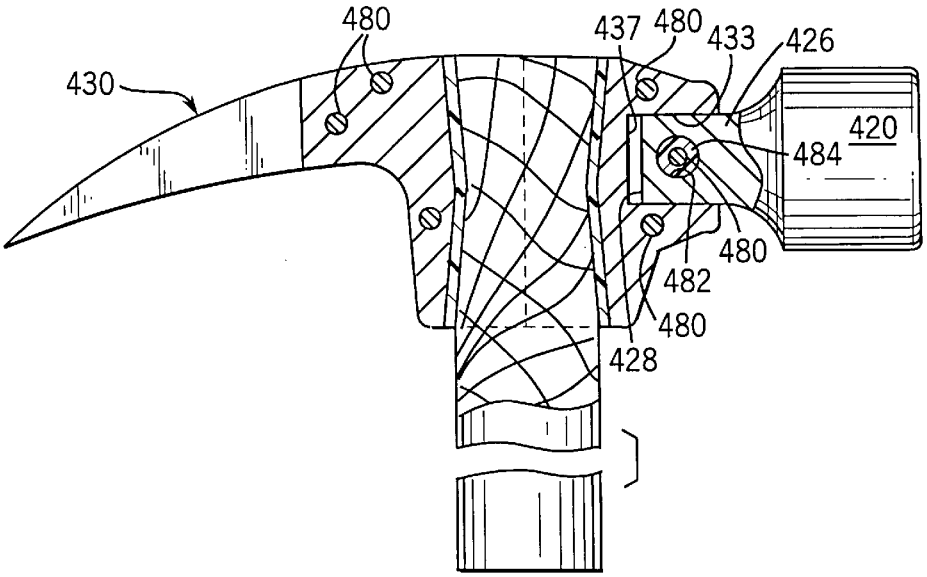
FIG. 13 is a sectional view taken along line 13—13 of FIG. 12.

FIGS. 12 and 13 illustrate an alternative embodiment of the invention substantially similar to that illustrated in FIGS. 10 and 11. This embodiment of the invention includes substantially the same structure as discussed above regarding tool 410 with the exception of the manner by which the striking head 420 is secured to the claw-like member 430. In this embodiment of the invention, the attachment portion 426 on the striking head 420 is configured as an axially elongated shank-like projection axially extending away from the striking head 420 and is slidably received for axial movement within a cavity 433 defined by the head piece or claw-like member 430. That is, and with this embodiment of the hammer 410, the axially extended projection 426 is arranged for endwise or axial sliding movement within the recess 433 in the claw-like member 430 defined by the two abutting laminations 470, 472.

As mentioned above, in this embodiment of the invention, a series of rivets or other suitable fasteners 480 serve to fixedly hold the laminations 470, 472 to each other. In the illustrated form of the invention, the rivets or fasteners 480 are shown as extending through the laminations 470, 472 and holding them in fixed relation relative to each other it will be appreciated by those skilled in the art, however, the fasteners do not necessary need to extend completely through both laminations 470, 472. Other alternative means of securing the laminations 470, 472 to each other would equally suffice without detracting or departing from the novel spirit and scope of the present invention. In the illustrated form of the invention shown in FIGS. 12 and 13, at least one elongated fastener 480 axially extends through the shank-like axial projection on head piece 420. The axially elongated projection 426 is provided with a through-bore 482 having a diameter greater than the diameter of the rivet or fastener 480 used to hold the laminations 470, 472 in assembled relation relative to each other. As shown in the drawings, a bearing sleeve of elastomeric material 484 fills the void around the rivet or fastener 480 and the internal diameter of the bore 482. The elastomeric material will have generally the same characteristics as mentioned above and will serve to maintain the impact surfaces 437 and 428 on the head members or pieces 420 and 430 of the head structure in predetermined axially spaced relation relative to each other while also allowing for the impact surfaces to collide with each other when the striking head 420 is stricken against a surface or object.

Figure 14:
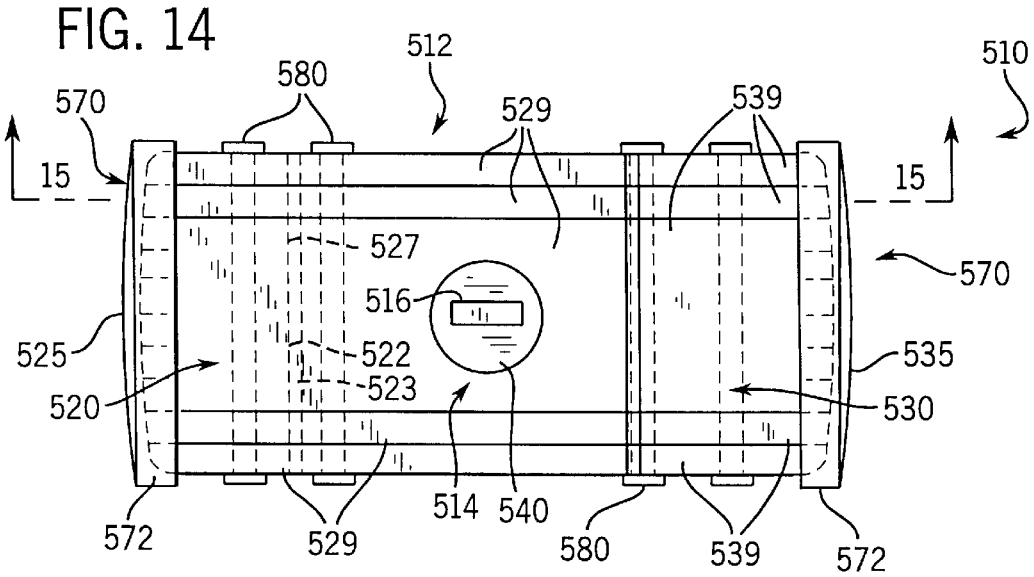
FIG. 14 illustrates a top plan view of still another alternative form of the present invention.
Figure 15:
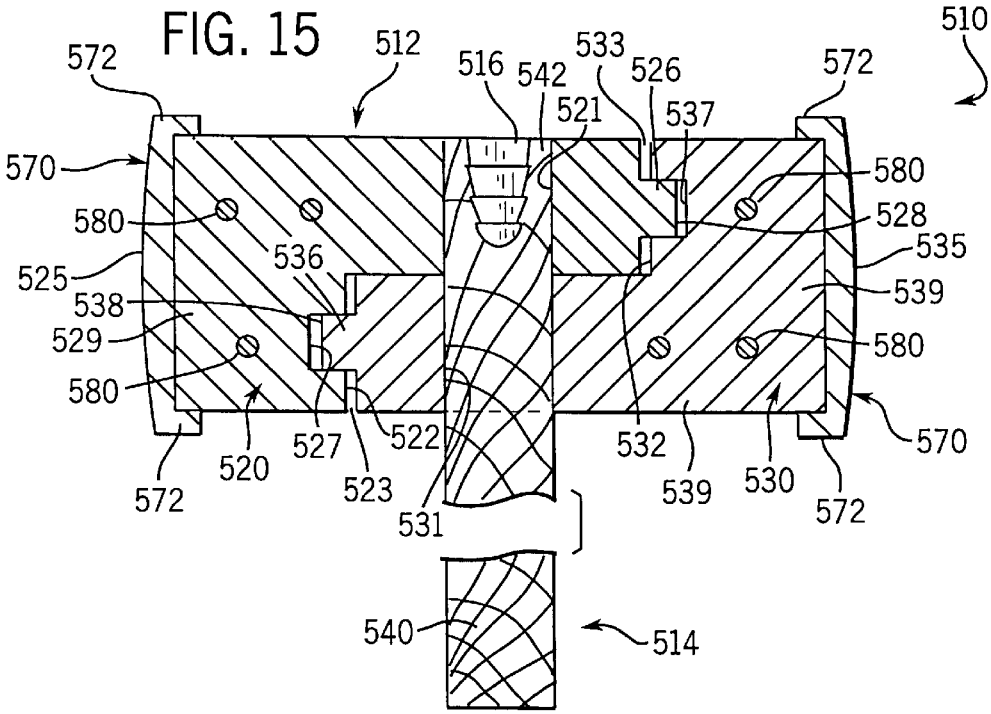
FIG. 15 is a sectional view taken along line 15—15 of FIG. 14.

A further embodiment of a tool embodying features of the present invention are schematically illustrated in FIGS. 14 and 15. This alternative form of impact tool is designated generally by reference numeral 510. The elements of this alternative form of impact tool that are identical to or functionally analogous to those components discussed above regarding impact tool 10 are designated by reference numerals identical to those used above with the exception that this embodiment uses reference numerals in the 500 series.

Tool 510 is similar in configuration to the tool 10 discussed above and shown in FIGS. 1 through 3. In this embodiment of the invention, the tool 510 includes a head structure 512 including first and second pieces or members 520 and 530, respectively, which are axially aligned in a first direction. The tool or hammer 510 further includes a handle structure 514 extending from the head structure 512 in a second direction and generally perpendicular to the head structure 512 thereby providing a generally T-shaped configuration to the tool 510.

The head pieces or members 520 and 530 of the head structure 512 are each formed from a series of laminations 529 and 539, respectively, fixedly held to each other by a series of suitable rivets or fasteners 580. Each plate or lamination 529 forming the head piece or member 520 is configured with a cutout 522 which, after the plates 529 are assembled relative to each other, define a recess 523 including at least one impact surface 527. Moreover, each lamination or plate 529 of the head member or piece 520 has an extension 526 having an impact surface 528 at a distal end thereof. Each plate or lamination 539 forming the head piece or member 520 is configured with a cutout 532 which, after the plates 539 are assembled relative to each other, define a recess 533 including at least one impact surface 537. Moreover, each lamination or plate 539 of the head member or piece 530 has an extension 536 having an impact surface 538 at a distal end thereof. Notably, when the laminated head pieces 520, 530 are assembled relative to each other, the impact surfaces 527, 538 and 537, 528, respectively, are arranged in confronting but predetermined spaced relationship relative to each other in substantially the same manner as discussed above.

In this embodiment of the invention, one each of the laminated plates 529, 539 forming the laminated head pieces 520, 530 of the head structure 512 is formed like the other except that one each of the plated 529, 539 is sufficiently sized to permit a bore 521, 531 to be provided therein for allowing a lengthwise portion of the handle structure 514 to extend endwise therethrough. As described above, the handle structure 514 furthermore preferably includes a suitably shaped member, such as a wedge-like member 516, which is driven into or operative extends from the free end 542 of the handle 540 of handle structure 514 to facilitate securement of the head structure 512 to the handle structure 514.

Such that either end of the head structure 512 can be used for striking purposes, a cap structure 570 fits about the ends of the laminations 529, 539 of the heads or members 520, 530 of the head structure 512. As will be appreciated, the cap structure 570 defines a striking surface 525, 535 for each head or member 520, 530 of the head structure 512. In the illustrated form of the invention, each cap structure 570 defines a peripheral wall or skirt 527 arranged in capturing and surrounding relation relative to the laminations 529, 539 of the head or members 520, 530 thereby inhibiting the laminations 529, 539 from "separating" relative to each other as the tool 510 is used to strike a surface. The cap structure 570 is secured as through any suitable means to the ends of the laminations 529, 539 forming the heads or members 520, 530 of the head structure 512. It is also within the scope of the present invention to configure the head structure of the impact tool 510 such that alternating laminations can be formed from an elastomeric material.

Figure 16:
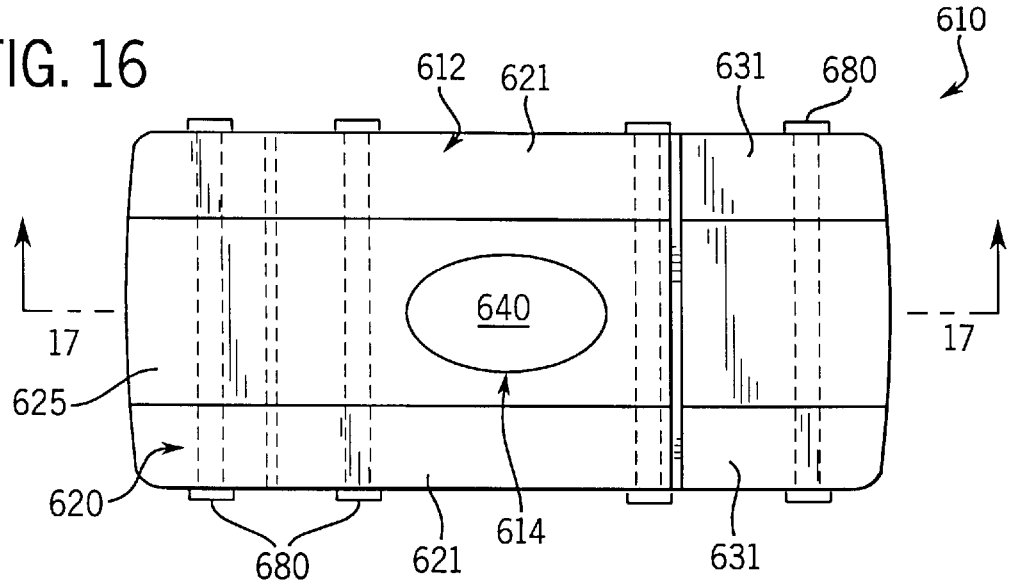
FIG. 16 is a top plan view of still another form of the present invention.
Figure 17:
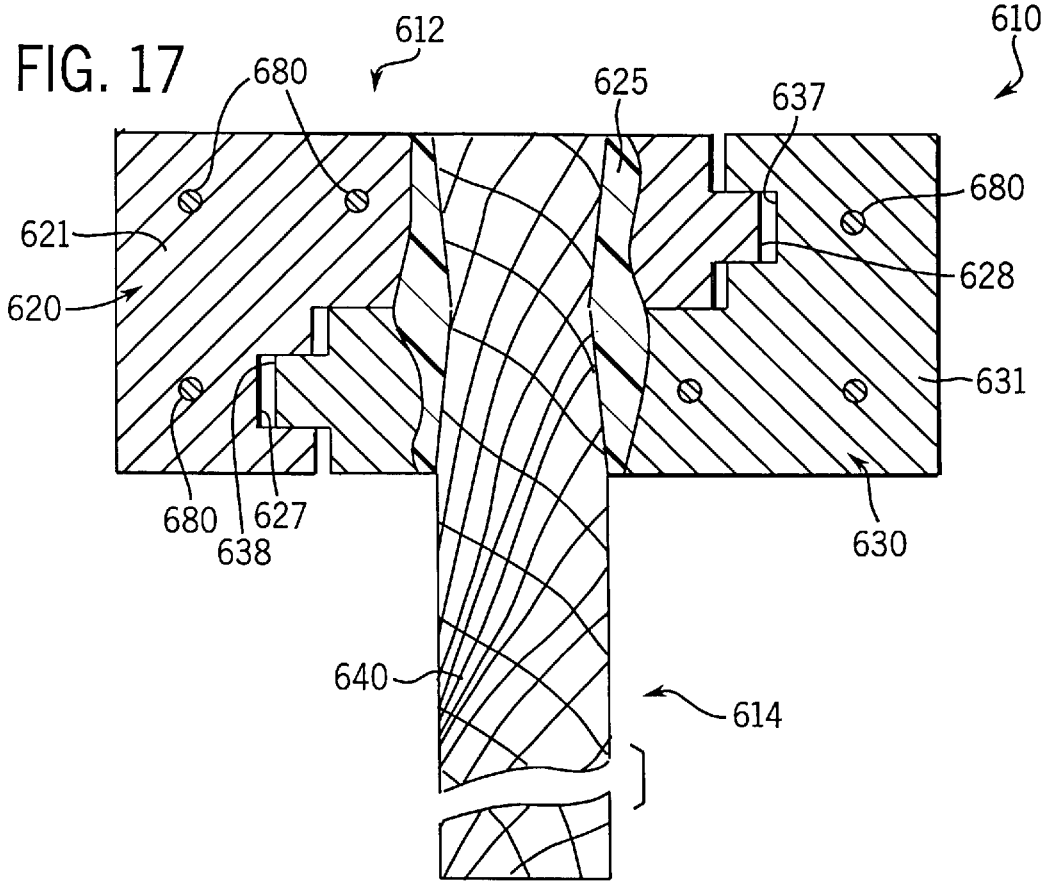
FIG. 17 is a sectional view taken along line 17—17 of FIG. 16.

A still further embodiment of a tool embodying features of the present invention are schematically illustrated in FIGS. 16 and 17. This alternative form of impact tool is designated generally by reference numeral 610. The elements of this alternative form of impact tool that are identical to or functionally analogous to those components discussed above regarding impact tool 10 are designated by reference numerals identical to those used above with the exception that this embodiment uses reference numerals in the 500 series.

The tool 610 is similar in configuration to the laminated tool 510 discussed above and shown in FIGS. 14 and 15. In this embodiment of the invention, the tool 610 includes a head structure 612 including first and second pieces or members 620 and 630, respectively, which are axially aligned in a first direction. The tool or hammer 610 further includes a handle structure 614 extending from the head structure 612 in a second direction and generally perpendicular to the head structure 612 thereby providing a generally T-shaped configuration to the tool 610.

The head pieces or members 620 and 630 of the head structure 612 are each formed from laminations 621 and 631, respectively, fixedly held to each other by a series of suitable rivets or fasteners 680. To reduce vibration transmission through the handle structure 614 and to allow the head pieces 620, 630 of the head structure 612 to collide relative to each other, at least one other lamination 625 formed from an elastomeric material is sandwiched or inserted between the laminations 621 and 631 forming the head pieces or member 620, 630 and is secured to each by the fasteners 680.

The laminations 621, 631 each define an impact surface 627, 638 and 628, 637, respectively, arranged thereon. The impact surfaces 627, 638 and 637, 628, respectively, on the laminations 621, 631 forming the head pieces or members 620, 630 of head structure 612 are arranged in confronting axially spaced relation relative to each other.

As shown, the handle structure 614 includes a one-piece handle 640 have a changing cross-sectional configuration along that lengthwise portion extending endwise through the elastomeric lamination 625 of the head structure 612. The changing cross-sectional configuration of the handle 640 is specifically configured to secure the elastomeric lamination 625 along the length of the handle structure 614. As shown, the lengthwise section of the handle 640 arranged in operative association with the head structure 612 preferably has an hourglass configuration. Accordingly, the handle 640 is prevented from axially moving along its length relative to the laminations 625 and, thus, relative to head structure 612. Of course, configurations other than that exemplified may equally suffice without detracting or departing from the scope of the present invention. Notably, however, the laminated or lengthwise split configuration of the head structure 612 allows such a design to capture the handle structure 614 relative to the head structure 612.

Figure 18:
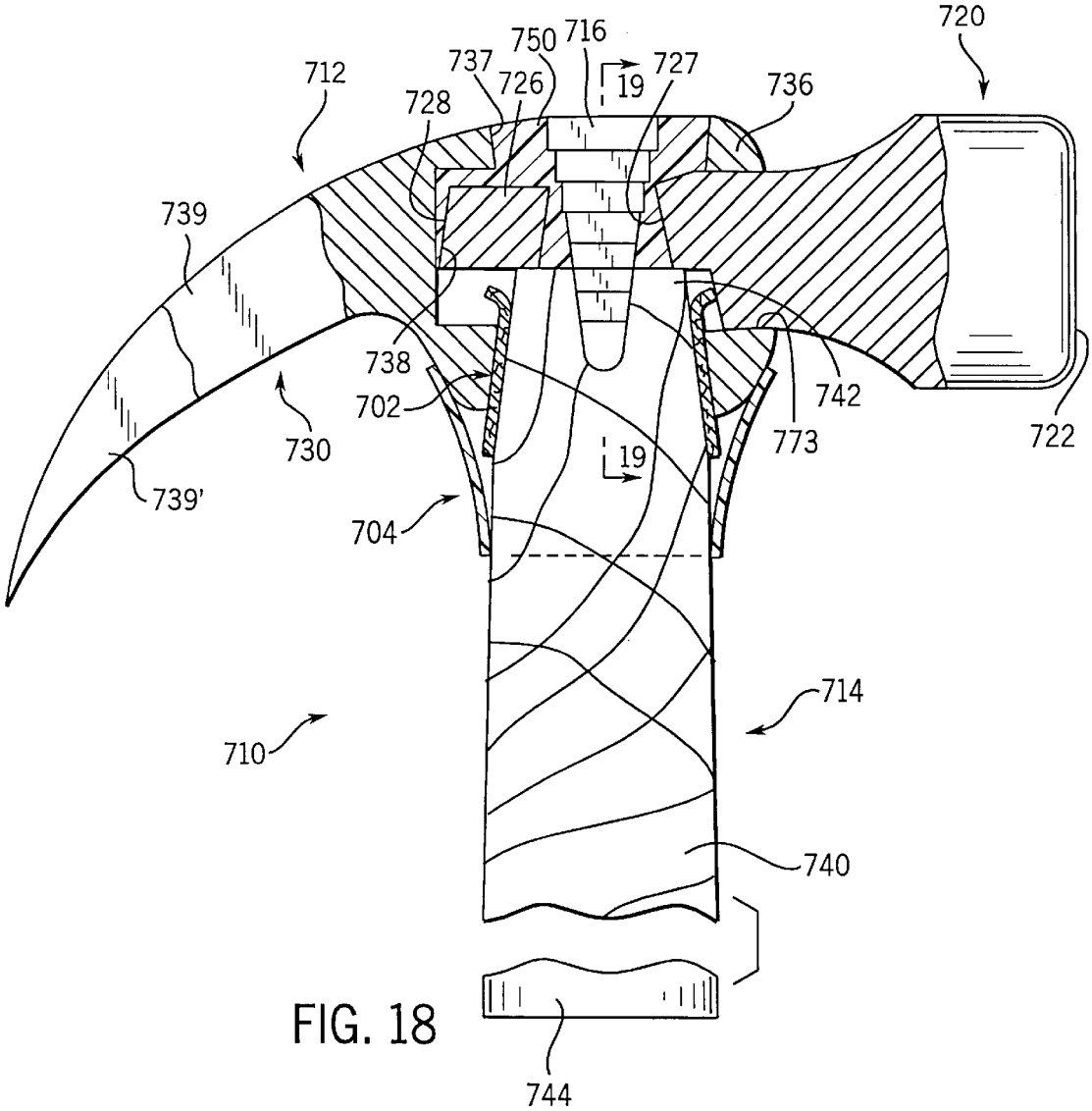
FIG. 18 is a partial longitudinal section of still, another embodiment of the present invention.
Figure 19:
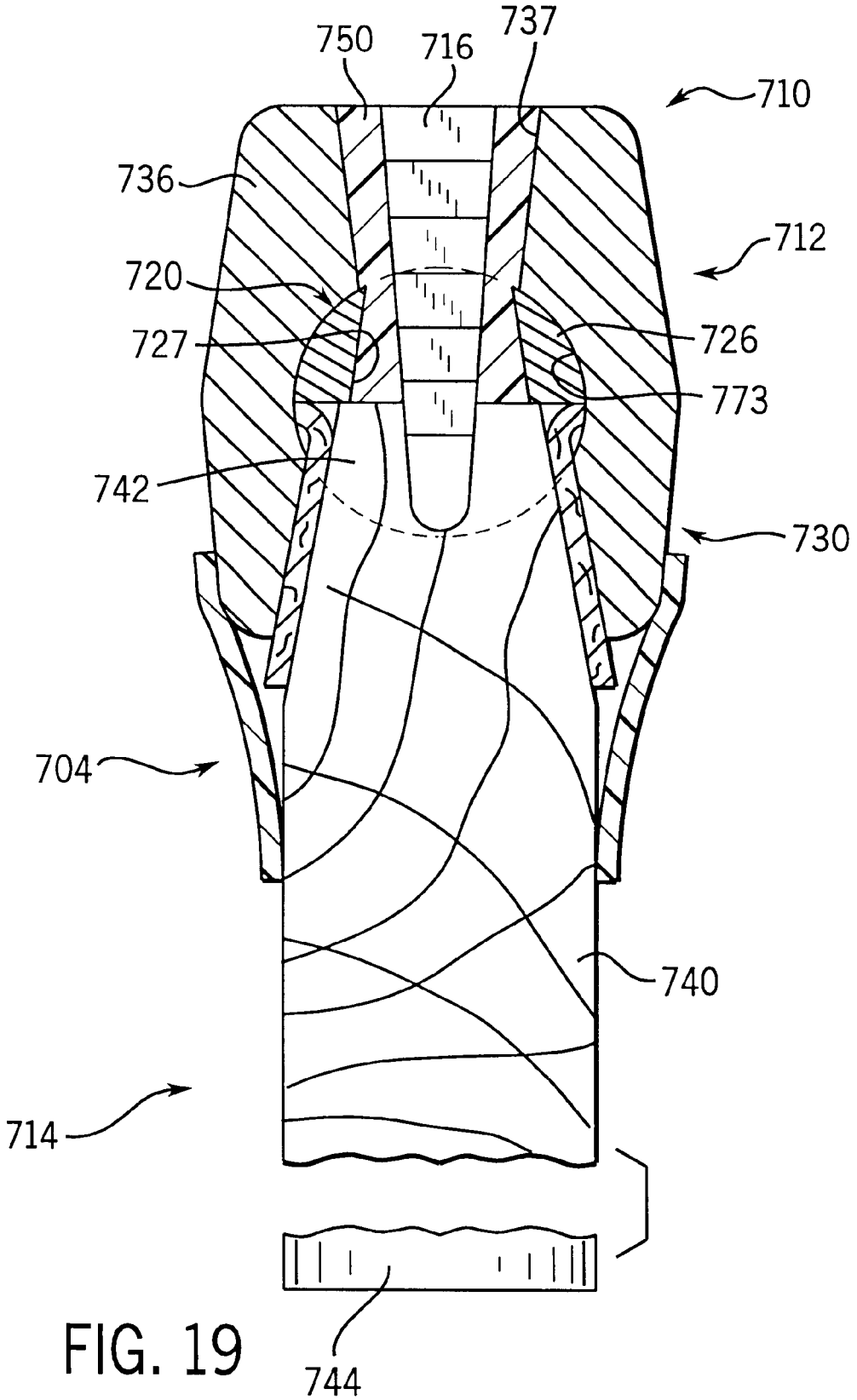
FIG. 19 is a sectional view taken along line 19—19 of FIG. 18.

FIGS. 18 and 19 schematically illustrate still another embodiment of an impact tool embodying salient features of the present invention. This alternative form of impact tool is designated generally by reference numeral 710. The elements of this alternative form of impact tool that are identical to or functionally analogous to those components discussed above regarding impact tool 10 are designated by reference numerals identical to those used above with the exception that this embodiment uses reference numerals in the 700 series.

Tool 710 is again configured as a carpentry hammer. The hammer 710 includes a head structure 712 and an elongated handle structure 714 extending generally normal to the head structure 712. One of the salient features involving this embodiment of the invention concerns the composite structure of the hammer 710. That is, in this embodiment of the invention, a skin or sock 702 extends about and along at least that lengthwise portion of the handle structure 714 extending into operative cooperation with the head structure.

In a preferred form of the invention, the skin 702 is fabricated from an arimid fiber material such as KEVLAR® marketed and sold by the DuPont Corporation. The arimid fiber material used in combination with the present invention has a unique combination of high strength, high modulus and toughness. The arimid fiber material or skin 702 is encapsulated or impregnated into an epoxy such as that sold and marketed by Ad-Tech as CER-112. This aspect of the present invention takes advantage of the natural tendency of the free ends of woven or braided fiber to fray and expand. As will be appreciated, and after the epoxy solidifies and hardens about the woven fabric or skin 702, the epoxy impregnated into the fiber sleeve maintains the frayed ends of the sleeve 702 in a radially expanded configuration, as schematically illustrated in FIG. 18, and thereby enhances the interface between the head structure 712 and the handle structure 714 while furthermore preventing the handle structure 714 from pulling out or separating from the head structure 712.

In one form, a cover 704 is disposed along and about a lengthwise portion of the handle structure 714 disposed beneath and in combination with the head structure 712. The purpose of the cover 704 is to extend about a lengthwise portion of the epoxied and impregnated fiber material extending beyond the head structure 712 of the tool 710. To maintain the distinctive character of the tool 710, however, at least a lengthwise portion of the cover 704 is transparent or otherwise visually permeable to permit visual access to the material skin 702 while inhibiting inadvertent unwrapping or unraveling of the impregnated fiber skin 702.

In that form illustrated in FIGS. 18 and 19, head structure 712 includes first and second pieces or members 720 and 730, respectively. The members or pieces 720, 730 of head structure 712 are joined by the elongated handle structure 714 extending, at least partially, therethrough.

As shown, the first member or piece 720 of head structure 712 is configured as a striking head with a striling surface 722. In the illustrated embodiment of the invention, the other piece or member 730 of the head structure 712 has a claw-like configuration including a pair of laterally spaced tines or members 739 and 739'.

In the illustrated form of the invention, and as made possible by the two-piece split head design, the head piece 720 includes an attachment portion 726 projecting away from and generally normal to the striking surface 722. The head piece 730 likewise includes an attachment portion 736 defining an elongated opening 773 for endwise receiving the attachment portion 726 of head piece or member 720. Notably, the opening 773 allows for radial expansion of the frayed free ends of the sock 702 in the manner described above. In the illustrated embodiment, the attachment portion 726 of head piece or member 720 has a generally semicircular configuration extending axially away from the distal end of member 720 arranged opposite from the striking surface 722 to provide further space for expansion of the free ends of the braided sock 702. Moreover, the distal end of the attachment portion 726 of head piece or member 720 defines an impact surface 728 arranged in confronting but spaced relationship to an impact surface 738 defined by an end wall of the elongated recess or opening 773 defined by head member or piece 730. The confronting impact surfaces 728, 738 on the heads 720, 730, respectively, are spaced from reach other in the same relationship described above to advantageously yield a dead-blow characteristic to the hammer 710.

As shown in FIGS. 18 and 19, the attachment portion 726 of head piece or member 720 further defines an open ended recess or opening 727 extending therethrough. Similarly, the attachment portion 736 of the head piece 730 defines a throughbore or opening 737 for accommodating the handle structure 714 and which opens to an upper surface of the head piece or member 730 of head structure 712. Notably, when the split head pieces or members 720 and 730 of head structure 712 are arranged in operative relationship relative to each other, as shown in FIGS. 18 and 19, the openings or recesses 727 and 737 defined by the attachment portions 726 and 736 of the head members 720 and 730, respectively, of head structure 712 are in general registry with one another.

A lengthwise portion of handle structure 714 of tool 710 extends through the head pieces or members 620, 730 of head structure 712 thereby joining them in operative combination relative to each other. In the embodiment of the invention schematically illustrated in FIGS. 187 and 19, handle structure 714 includes an elongated handle 740, a member 716 extending endwise from that end of the handle 740 extending into the head structure 712, and an elastomeric link 750 which operatively acts as a lengthwise extension of that portion of the handle 740 inserted into the head structure 712.

The handle 740 of the handle structure 714 is preferably formed from a class of materials including: woods, such as hickory; plastic; metal; nylon; fiberglass; or other suitable rigid material. The handle 740 has opposed ends 742 and 744. As shown in FIGS. 18 and 19, the end 742 of handle 740 is configured for insertion within the head structure 712 of the tool. In this regard, and to enhance its insertion within the head structure 712, the end 742 of handle 740 preferably has an inwardly tapered configuration.

In the illustrated form of the invention, member 716 of the handle structure 714 has a generally wedge-like configuration but any suitable design would equally suffice without detracting or departing from the spirit and scope of the present invention. For example, a screw threaded into the free end 742 of the handle 740 would equally apply. Notably, member 716 axially extends from and is secured to the free end 742 of handle 740 of handle structure 714. Moreover, the member 716 projects endwise through the openings 727 and 737 defined by the attachment portions 726 and 736, respectively, of the heads or pieces 720, 730 forming the head structure 712.

To further reduce vibrations from being transmitted along the handle structure 714 during use of the tool 710, handle structure 714 further includes the elastomeric link 750 for resiliently joining the head pieces or member's 720, 730 of the head structure 712 to each other and to handle structure 714. The elastomeric link 750 has a durometer hardness ranging between about 40 Shore A durometer hardness and about a 95 Shore A durometer hardness. As will be appreciated from an understanding of the present invention, the elastomeric link 750 acts as a spring for returning the nonstruck head of the head structure 712 to a normal or operational position after moving toward and impacting with the struck head or member of the head structure 712. Accordingly, any suitable material which, during use of the tool 710, will initially compress and subsequently return the unstruck head piece or member to an operational position relative to the struck head after the struck head has impacted with a surface will suffice.

Assembly of the impact tool 710 illustrated in FIGS. 18 and 19 preferably involves the following steps and processes. The free end 742 of handle 740, with the arimid sock to sleeve 702 arranged thereabout, is inserted into the head piece 730 of head structure 712. The attachment portion 726 of head piece 720 is then inserted into the opening 773 and into operative relationship with the head member 730. The epoxy or adhesive is the introduced through the openings 727 and 737 of the head pieces 720, 730, respectively, to impregnate and wet the arimid fiber sleeve 702 thereby enhancing the securement between the head structure 712 and handle structure 714 interface. Thereafter, member 716 of handle structure 714 is inserted into operative association with the free end 742 of handle 740 thereby causing outward radial expansion of the free end 742 of handle 740 and thereby further enhancing the securement between the head structure 712 and handle structure 714 interface. Next, an elastomer, such as polyurethane, is inserted or injected into the openings 727 and 737 of the head pieces 720 and 730, respectively, to completely fill the voids and surround that portion of member 716 extending axially from the handle 740. As will be appreciated, and when solidified, the polyurethane acts as the elastomeric link 750 joining the head pieces or members 720, 730 of head structure to each other and to handle 740.

The cover 704 can be arranged about the handle 740 of handle structure 714 prior to insertion of the handle 740 into operative association with the head structure 712. After the head structure 712 and handle structure 714 are fixed to each other, the cover 704 is slidably moved into the position illustrated in FIGS. 18 and 19 relative to the head structure 712. Alternatively, and in a manner well known in the art, the cover 704 can be molded about the handle 740 of handle structure 714 after the head structure 712 and handle structure 714 are arranged in operative association relative to each other.

The split head impact tool described above has several advantages over heretofore known impact tools. Unlike other impact tools, the heads or members of the head structure of the present invention are formed separate from each other. As will be appreciated, separately forming the heads or members of the head structure facilitates interchangability and significantly simplifies the manufacturing process. Rather than having to forge an entire head assembly for a impact tool, various manufacturing methods or processes can be used to fabricate the heads or member so the head structure of then present invention in the most economical fashion possible. For example, the separate heads or members of the head structure may be individually forged, cast, or they can be formed as laminated formations depending on which manufacturing process best serves the manufacturers needs.

Unlike heretofore known impact tools, the separate heads of the head structure of the present invention are interconnected to each other by the handle structure of the tool extending therethrough. In a preferred form of the present invention, each head or member of the head structure includes a working end or portion and an attachment portion. The attachments portions or ends of the heads or members of the head structure are interconnected to each other by the handle extending therethrough in a manner heretofore unknown.

The split head design of the present invention advantageously offers a unique "dead blow" characteristic during use of the impact tool. This dead blow characteristic is enhanced when elastomeric material is provided between the heads and opposite sides of the handle structure. The elastomeric material between the heads and the handle structure serves to maintain impact surfaces defined by the heads of the head structure in a predetermined spaced relationship relative to each other. The predetermined spacing between the impact surfaces on the heads or members of the head structure ranges between about 0.010 inches and about 0.070 inches. The spacing between the heads of the head structure is dependent upon a number of factors including: mass distribution or the head configurations; the hardness of the elastomeric material between the heads and the handle structure; the time of the collision between the impact surfaces; the length of time the striking head of the head structure remains in contact with the struck surface; and, whether the struck surface is stationary or movable. These are a few of the considerations for setting the spacing between the heads of the head structure.

The separated head design offered by the present invention allows the unstruck head of the head structure to act as a lagging mass that suppresses the rebound of the struck head. That is, the split heads of the head structure of the present invention are permitted to axially move along a predetermined path relative to each other such that when one head of the head structure is impacted on a surface of an object, the other head of the head structure moves toward and collides with the struck head thereby providing a secondary blow keeping the struck head from rebounding and, thus, deadening the blow of the hammer or impact tool. Moreover, the elastomeric material between the head structure and the handle structure serves to isolate the handle from the heads or members of the head structure, thus, significantly reducing the vibrations transferred along the handle to the user.

The alternative laminated structure for the heads of the head structure furthermore allows one head of the head structure to be captured by the other head of the head structure to further simplify the present invention. End caps define a striking surface for the head structure of the tool and inhibits "splitting" of the laminations during use of the tool.

As will be appreciated by those skilled in the art, the composite structure of such an impact tool design offers several advantages regardless of whether the head structure embodies a split head design or is of unitary construction. First, using the arimid fiber material in combination with an epoxy offers increased strength between the head structure and handle structure interface. Second, such a composite structure isolates the head structure 712 from the handle structure 714. Moreover, and because the skin 702 and epoxy add layers about that portion of the handle structure 714 passing into operative combination with the head structure 712 of the tool 710, a more complex and complicated path needs to be traversed by the vibrations when the head structure 712 is struck against a surface. As will be appreciated, the more complicated path for vibrations to travel between the struck head and the handle advantageously yields vibration dampening characteristics during use of the tool 710. Moreover, should a portion of the material skin or sock 702 extend beyond the head structure 712 and along a portion of the handle structure 714, its appearance will undoubtedly add distinctiveness to the hammer design.

From the foregoing it will be observed that numerous modifications and variations can be effected without departing or,detracting from the true spirit and scope of the novel concept of the present invention. It will be appreciated that the present disclosure is intended to set forth exemplifications of the invention which are not intended to limit the invention to the specific embodiments illustrated. The disclosure is intended to cover by the appended claims all such modifications as fall within the spirit and scope of the claims.

What is claimed is:

1. A hammer, comprising:

a head assembly including first and second members, each member of said head assembly including a working portion and an integral attachment portion, and wherein the attachment portions of said members extend to opposite sides of a longitudinal axis defined by a handle structure; and with said handle structure extending generally perpendicular to and through the attachment portions of said first and second members thereby operably interconnecting said first and second members of said head assembly to each other; and an elastomer arranged in operable association with said handle structure and the attachment portions of the first and second members of said head assembly such that confronting and spaced impact surfaces defined on said first and second members of said head assembly are maintained in spaced relation relative to each other by a predetermined distance measuring between about 0.010 inches and about 0.070 inches.

2. A hammer, comprising:

a head assembly including first and second members, each member of said head assembly including a working portion and an attachment portion, with the attachment portion of each member extending to opposite lateral sides of an elongated axis defined by a handle structure;

wherein said handle structure passes through and is secured to the attachment portions of said first and second members of said head assembly thereby limiting movement of the first and second members of said head assembly relative to the longitudinal axis of said handle structure, with said handle structure including an elongated handle extending generally perpendicular from said head assembly; and an elastomeric member arranged in operable association with the handle structure and said attachment portions of said first and second members.

3. The hammer according to claim 2 wherein said members of said head assembly are metal.

4. The hammer according to claim 2 wherein at least one of said members includes an exposed metal striking surface.

5. The hammer according to claim 2 wherein one of said members is configured as a striking head while the other member is configured as a claw.

6. The hammer according to claim 2 wherein said elastomeric member is formed from a urethane material having a durometer hardness ranging between about a 40 and about a 95 Shore A hardness.

7. An impact tool, comprising a head assembly including first and second members, each member of said head assembly including a working portion and an attachment portion, and wherein each member of said head assembly further includes an impact surface arranged in axially spaced but confronting relation to an impact surface on the other member;

handle structure defining an elongated axis, with said handle structure passing through and secured to the attachment portions of the first and second members extending to opposite sides of said axis thereby interconnecting said first and second members to each other; and elastomeric material disposed in operable association with said first and second members of said head assembly for maintaining said impact surfaces in predetermined spaced relation relative to each other, said elastomeric material acting as a dampener such that when one member of said head assembly is struck against a surface the unstruck member moves toward the struck member to provide a force that inhibits the struck member from bouncing from the surface and such that rebound of the impact tool is significantly reduced.

8. The impact tool according to claim 7 wherein at least one of the members of said head assembly has an exposed metal striking surface.

9. The impact tool according to claim 7 wherein one of the members of said head assembly is configured as a striking head while the other member of said head assembly is formed as a claw.

10. The impact tool according to claim 7 wherein the attachment portion of each member of the head assembly is arranged in surrounding relation relative to a lengthwise portion of said handle structure.

11. The impact tool according to claim 7 wherein the axial spacing between the confronting surfaces of the members of said head assembly measures approximately 0.010 inches to about 0.070 inches.

12. The impact tool according to claim 7 wherein both members of said head assembly are metal, and wherein said elastomeric member has a durometer hardness ranging between about 60 and about 95 Shore A hardness.

13. The impact tool according to claim 7 wherein said handle is formed from a class of materials including: wood, plastic, metal, nylon, fiberglass, or elastomers.

14. A generally T-shaped hammer, comprising:

a head assembly including first and second heads, with said first head extending in a first direction and defining a striking surface thereon, said first head including an attachment portion extending away from said striking surface and to one side of an elongated axis, and with said second head extending in a second direction opposed to said first direction, said second head including an attachment portion extending to an opposite side of said elongated axis;

handle structure extending generally normal to said first and second directions, said handle structure including an elongated handle whose longitudinal centerline defines said elongated axis, with a lengthwise section of said handle structure extending into operative association with the first and second heads and said head assembly thereby maintaining said heads in operable association relative to each other;

elastomer material arranged in operative association with said first and second heads for maintaining confronting impact surfaces defined by said heads in a predetermined spaced relationship relative to each other; and a woven fiber material disposed about and epoxied to a lengthwise section of said handle structure extending into operative association with said head assembly to enhance the interface therebetween while adding strength to the hammer.

15. The hammer according to claim 14 wherein said woven fiber comprises an arimid fiber.

16. A shock absorbing claw hammer, comprising:

a handle defining an elongated axis; and a head structure arranged in combination with and disposed at one end of said handle, said head structure including a striking head portion and a claw portion extending opposite from said striking head portion and defining a slit therebetween which opens to an exterior of said head structure, and wherein the striking head portion and the claw portion define confronting impact surfaces which are spaced a predetermined distance apart from each other, and wherein the head structure and handle combination is configured such that the impact surfaces are disposed to one side of the elongated axis with the spacing between said confronting impact surfaces collapsing upon a hammer strike thereby substantially eliminating vibrations in the handle resulting from the hammer strike.

17. The claw hammer according to claim 16 wherein said handle comprises part of a handle structure, and wherein said handle structure and said head structure comprise individual pieces.

18. The claw hammer according to claim 16 wherein said striking head portion and said claw portion comprise individual pieces.

19. The claw hammer according to claim 17 wherein said striking head portion and said claw portion of said head structure each include attachment portions, and wherein at least a lengthwise portion of said handle structure extends endwise through the attachment portions of said head portion and said claw portion.

20. The claw hammer according to claim 16 wherein the predetermined spacing maintained between the confronting impact surfaces of said striking head portion and said claw portion of said hammer ranges between about 0.010 inches and about 0.70 inches.

21. A shock absorbing claw hammer, comprising:

an elongated handle defining an elongated axis and having opposed sides; and a head structure arranged in combination with one end of said handle, said head structure including a striking head portion and a claw portion extending opposite from said striking head portion, and wherein the striking head portion and the claw portion define confronting impact surfaces, and wherein the head structure and handle combination is configured such that the impact surfaces are outwardly disposed to one side of the elongated axis and outwardly from opposed sides of said handle, and with a predetermined spaced relationship between said impact surfaces being maintained by an elastomer disposed within the head structure and which allows the spacing between the confronting impact surfaces to collapse other upon a hammer strike thereby substantially eliminating vibrations in the handle resulting from the hammer strike.

22. The claw hammer according to claim 21 wherein said handle comprises part of a handle structure, and wherein said handle structure and said head structure comprise individual pieces.

23. The claw hammer according to claim 22 wherein said striking head portion and said claw portion of said head structure each include attachment portions, and wherein at least a lengthwise portion of said handle extends endwise through the attachment portions of said head portion and said claw portion.

24. The claw hammer according to claim 21 wherein said striking head portion and said claw portion comprise individual pieces.

25. The claw hammer according to claim 21 wherein the predetermined spacing maintained between the confronting impact surfaces of said striking head portion and said claw portion of said hammer ranges between about 0.010 inches and about 0.70 inches.

* * * * *